US007313884B2

(12) United States Patent
Eddins

(10) Patent No.: US 7,313,884 B2
(45) Date of Patent: Jan. 1, 2008

(54) RECOIL SUPPRESSING GUN SUPPORT

(75) Inventor: Wallace Eddins, Patchuta, MS (US)

(73) Assignee: Lake Eddins, LLC, Patchuta, MS (US)

( * ) Notice: Subject to any disclaimer, the term of this patent is extended or adjusted under 35 U.S.C. 154(b) by 196 days.

(21) Appl. No.: 11/107,899

(22) Filed: Apr. 18, 2005

(65) Prior Publication Data

US 2006/0230664 A1 Oct. 19, 2006

(51) Int. Cl.
*F41A 23/02* (2006.01)
*F41A 23/16* (2006.01)
*F41A 31/00* (2006.01)

(52) U.S. Cl. ..... 42/94; 89/37.04; 42/90

(58) Field of Classification Search ..... 89/37.04; 42/90, 94

See application file for complete search history.

(56) References Cited

U.S. PATENT DOCUMENTS 2,847,909 A * 8/1958 Kester ..... 89/40.06
4,055,017 A * 10/1977 Thompson ..... 42/94
4,333,385 A * 6/1982 Culver ..... 89/37.04
4,345,398 A * 8/1982 Pickett ..... 42/94
4,967,497 A * 11/1990 Yakscoe ..... 42/94
4,972,619 A * 11/1990 Eckert ..... 42/94
5,070,636 A * 12/1991 Mueller ..... 42/94
5,272,955 A * 12/1993 Bond et al. ..... 89/37.04
5,414,949 A * 5/1995 Peebles ..... 42/94
5,628,135 A * 5/1997 Cady ..... 42/94
5,666,757 A * 9/1997 Helmstadter ..... 42/94
5,811,720 A * 9/1998 Quinnell et al. ..... 89/37.04
5,913,668 A * 6/1999 Messer ..... 42/94
6,338,218 B1 * 1/2002 Hegler ..... 42/94

* cited by examiner

*Primary Examiner*—Bret Hayes
(74) *Attorney, Agent, or Firm*—Ronald E. Greigg

(57) ABSTRACT

A gun support includes an elongated base having a stock cradle at one end and a barrel saddle at the other for supporting a long barrel gun in position for shooting. A hinge has one hinge plate pivotally connected to the elongated base for pivotal movement in a plane parallel to the hinge plate. The other hinge plate is adapted to be attached to a support surface adjacent a horizontal edge thereof, whereby the gun may pivoted about the hinge pin and the base mounting pin to sight the gun for shooting, and pivoted about the hinge pin to position the gun in a safe, nozzle down position when not in use for shooting.

13 Claims, 1 Drawing Sheet

RECOIL SUPPRESSING GUN SUPPORT

BACKGROUND OF THE INVENTION

1. Field of the Invention

This invention relates to an improved gun support for steadying a gun during shooting, and more particularly to such a gun support which not only permits freedom of movement of the gun for sighting and which suppress recoil during shooting but also supports the gun in a safe, space saving position until the user is ready to shoot.

2. Description of the Prior Art

Gun rests to assist a shooter in steadying a gun for shooting are well known and are used, for example, in sight alignment of the gun and in bench rest target shooting as well as in wild game hunting. For example, U.S. Pat. No. 5,070,636 discloses a gun rest especially intended for use in sight alignment of a rifle in which the barrel of the rifle is positioned in a generally Y-shaped saddle support at one end of an elongated base or frame member and the stock is resiliently retained in a cradle at the other end of the base. A tripod-like arrangement provides a three-point support for positioning the base on a horizontal surface such as a table top, with one support including a table engaging friction pad provided under the base near the stock cradle end, and two laterally spaced table top engaging thumb-screw supports provided on a rigid metal structural metal member welded to and projecting laterally from the bottom surface of the elongated base at it's other end. The structural member is illustrated as an angle including a downwardly directed leg adapted to be positioned in contact with the end edge of the support table to absorb the kick, or recoil, when the rifle is fired. An elastic cord-like strap may be used around the base and the rifle barrel to secure the gun to the sighting apparatus. Sighting of the rifle involves moving the device over the table top for horizontal alignment and adjustment of the thumb screw supports for vertical alignment; the device is intended for use only in sighting of the gun and would have no practical application for game or varment shooting.

U.S. Pat. No. 6,338,218 discloses a gun support device including a support bracket adapted to be releasably mounted on the top of a vertical wall structure such as in a "window" opening of a shooting blind, or on the top ledge of a pickup truck bed. The device includes a vertical post pivotally supporting an elongated arm for movement about a generally vertical axis, with a pair of spaced, generally U-shaped gun rests or saddles extending above the elongated arm, one adjacent each end thereof, and the saddles are spring mounted for resiliently resisted vertical movement. During use, the gun rests loosely in the saddles, with the pivotal support of the arm permitting movement in the horizontal plane and the spring mounting of the saddles permitting limited movement in the vertical plane.

Other known gun rests are disclosed, for example, in U.S. Pat. Nos. 499,315; 4,913,391; 5,481,817; and 5,933,999.

While the above and other known gun support devices have generally enabled more accurate sighting of a gun than could be achieved by the shooter without the aid of such support, they have not been entirely satisfactory for both outdoor use for game hunting or varment shooting and for indoor bench or table rest target shooting. Also, many of the known devices do not absorb the recoil of large caliber guns, as is desired by many shooters, especially smaller shooters such as women and young or inexperienced persons. Further, space is generally at a premium in outdoor shooting shelters or blinds, and the known devices intended for use in such places generally have not been able to support a gun in position for immediate use while occupying a minimum of space. It is therefore a primary object of the present invention to provide an improved gun support device suitable for use both for indoor bench rest or table rest target shooting and for outdoor use for game hunting or varment shooting.

Another object is to provide such a gun support which is easy to use and which effectively absorbs the gun recoil or transfers the recoil to a grounded support.

Another object is to provide such a device which is readily transportable, easy to use, and which can supports the gun in a safe, space-saving position between shots.

SUMMARY OF THE INVENTION

In the attainment of the above and other objects, an important feature of the invention resides in providing a support frame including an elongated base member having a stock cradle rigidly mounted on and projecting upwardly from its top surface at one end and a generally Y-shaped barrel support saddle adjustably mounted on and projecting upwardly from its other end. A mounting plate preferably is joined to the bottom surface of the elongated base, at a point near its mid-section, by a bolt, for example, extending through bores in the base and mounting plate with the holes providing sufficient clearance to permit free pivotal movement of the base relative to the mounting plate about the longitudinal axis of the bolt. A connecting member or plate is hingedly joined to the mounting plate for movement between a position parallel to the mounting plate and a position extending substantially perpendicular to that surface. The connecting plate has openings therein for receiving fasteners such as screws, nails or the like for releasably joining the relatively moveable connecting plate to a vertically extending ground structure such as a vertical wall of a hunting blind or an end or side surface of a shooting bench or table.

When using the gun support for shooting game such as deer or bear, for example, from a hunting shelter, the movable connector plate, or hinge plate, is mounted to the exterior wall of the shelter at the viewing and shooting opening or window, and the mounting plate is pivoted to a horizontal position resting on the window frame structure with the base member extending in a generally horizontal plane. The gun is then placed in the support with the stock in its cradle and the barrel resting in the barrel saddle, and elastic retainers on the support are then extended over the stock and barrel to retain the gun on the gun support. The barrel support is then vertically adjusted to permit sighting the gun to the highest elevation where game may appear.

When the gun support is mounted to the hunting shelter wall, the support, with the gun attached, may then be pivoted about the hinge mounting to a position outside the shelter with the gun barrel pointing vertically downward along the outside of the shelter wall, and with the gun stock readily accessible through the shelter window opening, thereby leaving more unobstructed space inside the shelter where space is generally very limited.

When a game animal is spotted, the gun and support may be pivoted about the hinge to the shooting position by the hunter concealed within the shelter, with little movement visible by the animal. The hunter can then sight the gun by pivoting the gun and base member in a horizontal direction about the pivot bolt through the mounting plate, and in the vertical direction about the hinged connection plate. In this process, the hunter places the stock cradle against his shoulder in the same manner that the gun stock would be positioned without the gun support, but when the gun is fired, the recoil, or kick, is essentially absorbed by the gun support and transferred to the shelter frame structure.

BRIEF DESCRIPTION OF THE DRAWINGS

Other features and advantages of the invention will become apparent from the detailed description contained herein below, taken in conjunction with the drawings, in which.

DESCRIPTION OF THE PREFERRED EMBODIMENTS

Figure 1:
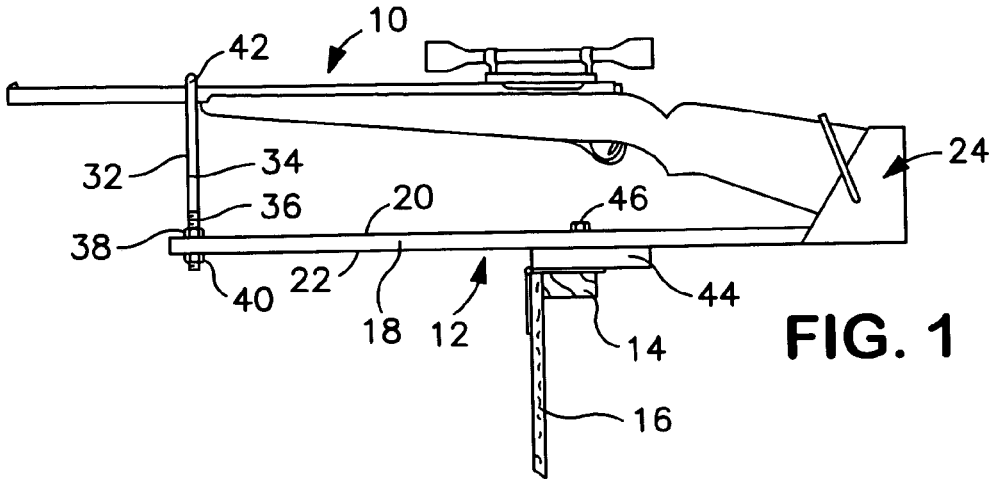
FIG. 1 is a side elevation view of rifle supported on a gun support according to the invention and mounted to an opening of a hunting shelter in position for shooting.

Referring now to the drawings in detail, FIG. 1 shows a rifle 10 supported in a gun support indicated generally by the reference numeral 12 mounted on the exterior wall surface 14 and resting on the window sill 16 of a hunting shelter or blind, not otherwise shown. The gun support 12 comprises an elongated base member 18, preferably of generally rectangular cross section and having substantially flat top and bottom surfaces 20, 22, respectively. Base member 18 may, for example, be a length of rectangular pipe or tubing having outside dimensions of about 1 inch by 2 inches and being formed of steel or aluminum, or for smaller caliber guns, the base 18 may be of wood or plastic material.

A stock cradle 24 is rigidly mounted, as by welding or by screws, on one end of base 18, for receiving the end portion of the rifle stock. Cradle 24 is preferably formed from a single piece of light gage metal plate bent into a generally U-shaped configuration with opposed side walls 26, 28 extending along and upwardly from the lateral side edges of base 18 and an end wall 30 extending across and upwardly from the end of base 18. If desired, a protective cover or coating material, not shown, may be provided on the inner or opposed surfaces of side walls 26, 28, and end wall 30, and a shock absorbing or cushioning material (not shown) may also be provided on the inner surface of end wall 30 to protect the gun stock from scratches or damage from recoiling against the rigid support cradle.

A barrel support or saddle 32 is mounted on the end of base 18 opposite the cradle 24 and projects upwardly from surface 20. Support 32 may consist of an elongated rod member 34 having a threaded end portion 36 extending through a central opening in base 18, with nuts 38, 40 engaging surfaces 20, 22, respectively, locking the barrel saddle in the desired position. An open generally U-shaped saddle 42 is formed in the upwardly projecting end of rod 34, and the nuts 38, 40 may be adjusted along the threaded end 36 to adjust the position of the saddle 42 above the top surface 20 of base 18.

A generally rectangular mounting plate 44 is attached to the bottom surface of the base 18, at a position approximately midway between its two ends, by a bolt 46 extending downwardly from surface 20 through an opening 48 in base 18 and a corresponding opening 50 in the mounting plate. A nut 52 is threaded onto the end of the bolt 46, preferable in a recess 54 in the bottom surface of mounting plate 44. The openings 48, 50 are slightly larger than the diameter of bolt 46, and the nut 52 is preferably a lock nut which is only turned onto the bolt a distance to retain the mounting plate and base in assembled relation while permitting free relative rotation of base 18 and mounting plate 44 to promote smooth movement for sighting. Plate 44 may be of wood, metal, plastic or other suitable material capable of absorbing the recoil, or kick of the gun.

A hinge 58, for example, a conventional strap hinge, has one hinge plate 60 firmly attached, as by screws, to the bottom surface, i.e., the surface opposite base 18, of mounting plate 44, with its hinge pin 62 extending parallel with and adjacent to one edge of the mounting plate. The second hinge plate 64 is free to rotate about pin 62 from a position overlapping hinge plate 60 to a position engaging surface 22 of base 18. Other hinge arrangements may be employed; for example, a removable pin may be inserted through an opening in the mounting plate and through openings in support members at each lateral edge of the mounting plate.

In an alternate embodiment, the mounting plate may be omitted, and the bolt 46 may be replaced by a stud having one end rigidly joined, as by welding, to the surface of the first hinge plate 60. If desired, or necessary, hinge plate 60 may be reinforced to avoid distortion from the gun's recoil after repeated firing. Also, the bolt 46 may extend through base 18 and be threaded into a threaded bore in the first hinge plate 60 or into a nut welded to the hinge plate.

Resilient means such as elastic bands 66 or cords are provided on the stock cradle and barrel saddle to releasably retain the rifle in position on the gun support. Alternatively, endless elastic bands or elastic cords with connectors such as conventional elastic tie-downs may be placed around the base 18 and the gun barrel and stock to retain the gun in position.

In use of the gun support of the present invention, the support is firmly but releasably attached to a supporting ground structure having intersecting generally horizontal and vertical surfaces by placing the mounting plate on the edge portion of the horizontal ground surface and permitting the free hinge plate 64 to extend downwardly along the vertical ground surface. In this position, hinge plate 64 is firmly but releasably attached to the vertical wall. The rifle 10 is then positioned on the gun support and releasably attached thereto as by the elastic cords 66. The gun can then be pivoted in a vertical plane about the horizontal hinge pin 62 from the position shown in FIG. 1 in which the mounting plate rests on the supporting window sill 14, support table, post, or the like, to the position shown in FIG. 2 in which the gun barrel is pointed substantially vertically downward in spaced relation to the vertical support surface.

The saddle 42 is then adjusted so that the gun may be sighted to the highest elevation for any shot to be taken with the mounting plate 44 resting on the horizontal support surface. To shoot at a target at a lower elevation, the gun and support may be tilted downward about the hinge pin 62 and pivoted about the vertical axis of bolt 46. By using a hinge with a relatively long hinge pin with little play, excellent gun support is provided for very accurate shooting either in indoor target shooting or outdoor shooting, and the hinge is capable of transferring the force of the recoil to the supporting ground structure.

It is believed apparent that the second hinge plate 64 might also be attached to a horizontal support surface such as a window sill or table top, adjacent an edge thereof, so that in the shooting position, the two hinge plates are in generally parallel, overlying relation, and in the safe, storage position, the first hinge plate, with the support device mounted therein, extends in a generally vertical plane upwardly from the hinge pin.

Figure 2:
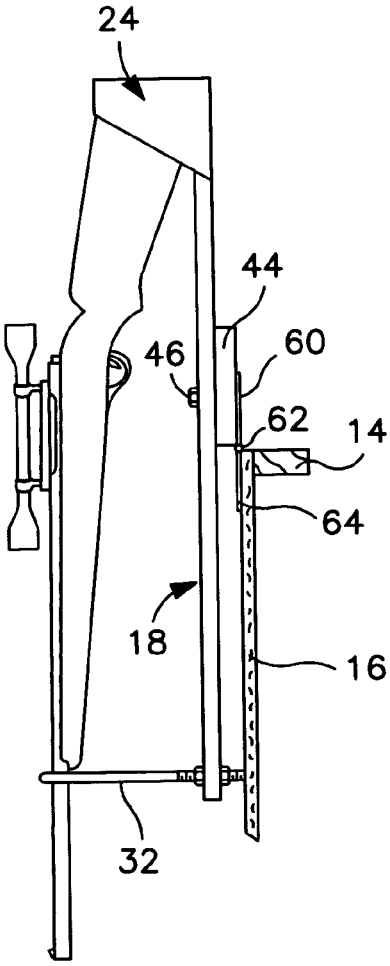
FIG. 2 is a view similar to FIG. 1, with the rifle and gun support tilted to a non-use or safe position.
Figure 3:
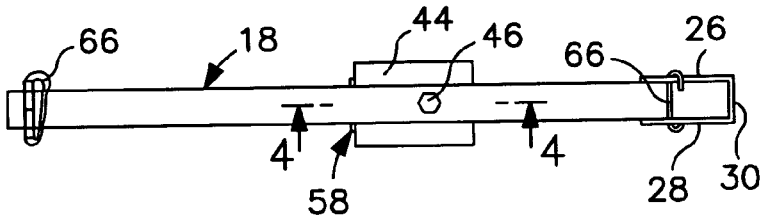
FIG. 3 is a top plan view of the gun support shown in FIGS. 1 and 2.
Figure 4:
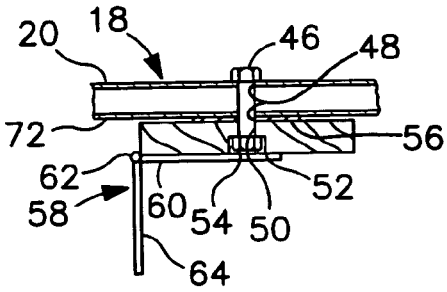
FIG. 4 is an enlarged fragmentary sectional view taken along lines 4-4 of FIG. 3.

When the gun is not being fired, as in a game hunting setting in which the hunter is sitting in a blind or shelter waiting for game to come within range, the gun and gun support is pivoted to the position shown in FIG. 2 in which the gun is supported in a safe, substantially vertical, nozzle down position outside the shelter. This position also provides more room inside the shelter to enable the shooter (or shooters) to move in the confined space. Even in the safe position, the gun is always essentially ready for shooting simply by tilting the gun back to the shooting position.

It is believed apparent that the gun support could be mounted for movement to the safe position inside the shelter where space in the shelter permits and where it is desired to protect the gun from exposure. To use the gun when the gun support is mounted in this position, it is necessary to rotate the gun and support through substantially 180° about the vertical axis of bolt (46) for shooting. Also, the barrel saddle would be adjusted to the lowest anticipated shooting angle, then the barrel would be elevated by pivoting about pin 62 for sighting.

While preferred embodiments of the invention have been illustrated and described, it is not intended that the invention be limited to such embodiments, but rather it is intended to include all embodiments which would be apparent to one skilled in the art and which come within the spirit and scope of the invention.

I claim:

1. A gun support device for supporting a gun having a long barrel and a stock during shooting, the device compressing an elongated base having top and bottom surfaces, a barrel support saddle mounted on one end portion of said base and projecting above said top surface, saddle adjusting means for adjusting the height of said saddle above said top surface, a stock cradle mounting on and projecting above said top surface at the other end of said base, said stock cradle including an end wall and laterally spaced side walls cooperating to define a stock receiving pocket engaging the butt end and adjacent sides of the stock of a gun positioned on the device, means for releasably retaining a gun on the device with the gun stock resting in the stock cradle and the gun barrel resting in the barrel saddle, and hinge means for mounting the base member to a support surface, the hinge means having first and second hinged members pivotally connected by a hinge pin, and connecting means pivotally mounting said first hinged member to said base for movement about a bearing axis perpendicular to said base and for movement therewith about said hinge pin whereby, when the second hinge member is mounted to a support structure, the device and a gun supported thereon may be pivoted about said bearing axis and about the axis of said hinge pin.

2. The gun support device as defined in claim 1, wherein said means for releasably retaining a gun on the device comprises at least one elongated elastic cord or band.

3. The gun support device as defined in claim 1, wherein said hinge means comprises first and second hinge plates pivotally connected by a hinge pin.

4. The gun support device as defined in claim 1, wherein said hinge means permits movement of the device and a gun supported thereon through an angle of at least about 90° about said hinge pin to pivot the gun between a shooting position and a safe storage position.

5. The gun support device as defined in claim 3, wherein said connecting means comprises a mounting plate rigidly connected to said first hinge plate, and pivot means connecting the mounting plate to the base member for relative pivotal movement.

6. The gun support device as defined in claim 4, wherein said connecting means comprises a mounting plate rigidly connected to said first hinge plate, and pivot means connecting the mounting plate to the base member for relative pivotal movement.

7. The gun support device as defined in claim 1, wherein said barrel saddle means includes adjustment means for adjusting the position of the barrel of a gun supported on the device relative to said top surface.

8. The gun support device as defined in claim 3, wherein said barrel saddle means includes adjustment means for adjusting the position of the barrel of a gun supported on the device relative to said top surface.

9. The gun support device as defined in claim 4, wherein said barrel saddle means includes adjustment means for adjusting the position of the barrel of a gun supported on the device relative to said top surface.

10. The gun support device as defined in claim 1, further comprising friction reducing means between said base and said connecting means.

11. The gun support device as defined in claim 5, further comprising a washer or sheet of low friction material between said base and said mounting plate.

12. A method of supporting a long barrel gun for shooting, the method comprising positioning the gun on an elongated base having a stock cradle at one end and a barrel saddle at the other end, resiliently retaining the gun on the elongated base, mounting the elongated base on a first hinge plate of a hinge assembly for pivotal movement in a plane parallel to the first hinge plate, the hinge assembly having a second hinge plate joined to said first hinge plate by a hinge pin, and attaching the second hinge plate to a support surface adjacent a horizontal edge thereof, whereby the gun may be pivoted about its pivotal mounting on the first hinge plate and about said hinge pin to sight the gun.

13. The method defined in claim 12, further comprising the steps of pivoting the gun and the elongated base about said hinge pin to a substantially vertical, nozzle down safe position when the gun is not being fired.

* * * * *